US005601404A

United States Patent [19]

Collins

[11] Patent Number: 5,601,404

[45] Date of Patent: Feb. 11, 1997

[54] INTEGRAL DISC SEAL

[75] Inventor: Larry Collins, Newport, Great Britain

[73] Assignee: Rolls-Royce PLC, London, England

[21] Appl. No.: 551,316

[22] Filed: Nov. 1, 1995

[30] Foreign Application Priority Data

Nov. 5, 1994 [GB] United Kingdom ..... 9422542

[51] Int. Cl.[6] ..... F01D 11/02

[52] U.S. Cl. ..... 415/173.7; 416/220 R; 416/224 A

[58] Field of Search ..... 415/173.7, 174.5; 416/219 R, 220 R, 244 A

[56] References Cited

U.S. PATENT DOCUMENTS

| | | | |
|---|---|---|---|
| 3,023,998 | 3/1962 | Sanderson | 415/173.7 |
| 3,047,268 | 7/1962 | Leavitt | 415/173.7 |
| 3,051,436 | 8/1962 | Kent et al. | 416/244 A |
| 3,067,980 | 12/1962 | Welsh | 416/244 A |
| 3,761,200 | 9/1973 | Gardiner | 416/220 |
| 3,846,899 | 11/1974 | Gross . | |
| 4,813,848 | 3/1989 | Novotny | 416/244 A |

FOREIGN PATENT DOCUMENTS

| | | | |
|---|---|---|---|
| 235171 | 1/1926 | United Kingdom . | |
| 780137 | 7/1957 | United Kingdom . | |
| 0780137 | 7/1957 | United Kingdom | 415/173.7 |
| 816288 | 7/1959 | United Kingdom . | |
| 1295003 | 11/1972 | United Kingdom . | |
| 1318654 | 5/1973 | United Kingdom . | |
| 1394739 | 5/1975 | United Kingdom | 416/244 A |
| 1527074 | 10/1978 | United Kingdom . | |
| 2253442 | 9/1992 | United Kingdom . | |
| 2274688 | 8/1994 | United Kingdom . | |

*Primary Examiner*—Edward K. Look
*Assistant Examiner*—Mark Sgantzos
*Attorney, Agent, or Firm*—Oliff & Berridge

[57] ABSTRACT

A disc for use in an axial flow turbomachine having a main flow annulus which includes an inner flow boundary defined by axially adjacent stator vane and rotor blade platform sections. The disc comprises an axially extending sealing member which extends from its radially outer periphery to bridge the gap between adjacent rotor blade and stator vane platform sections. The sealing member is formed integrally with the disc. The arrangement minimises the unsealed stator well region between the rotatable and non-rotatable platforms and thereby provides for improved operational flow stability.

24 Claims, 2 Drawing Sheets

INTEGRAL DISC SEAL

BACKGROUND OF THE INVENTION

This invention relates to gas turbine engine seals, and in particular gas turbine engine stator well seals.

Axial flow turbomachines such as gas turbine engines are often constructed in such a way that the platform sections of adjacent blades combine to form the inner flow boundary of the machine's annular gas flow path. Since the gas path usually extends over a plurality of adjacent stages the flow boundary often comprises both stator and rotor blade platforms. Seals are provided between the adjacent rotatable and non-rotatable platform sections to prevent working fluid leakage from the gas flow path during engine operation.

In a known arrangement the rotor blades locate in axial root slots formed in the circumferential periphery of a rotor disc, and the stator vanes in adjacent stator vane support structure which may also define the stator vane platform flow boundary. An annular seal member is provided which extends from the periphery of the rotor disc towards the adjacent stator vane support structure to seal the gap therebetween. The seal member is attached to the disc by bolts or the like, and forms a labyrinth type seal with the underside of the stator vane platform or vane support structure at it's distal end.

A problem with this approach is that disc/seal member assembly considerations tend to compromise the seal design. Large stator well volumes often result in the region between the disc periphery and the stator vane support structure. These voids are undesirable since they tend to upset the aerodynamic stability of the gas flow through the annular flow path during engine operation. In axial flow compression systems this can have a severe impact on the stability characteristics of the compressor.

SUMMARY OF THE INVENTION

It is an object of the invention, therefore, to provide a sealing arrangement for use between relatively rotatable flow boundaries in axial flow turbomachines which minimises stator well volumes.

According to a first aspect of the invention there is provided a sealing arrangement for use in an axial flow turbomachine having a main flow annulus which includes a rotatable annular flow boundary fixed in relation to and spaced from the periphery of a rotor disc, and a non-rotatable annular flow boundary axially adjacent to and spaced from the rotatable boundary, wherein the sealing arrangement comprises an annular sealing member which extends from the disc periphery to bridge the gap between the rotatable and non-rotatable flow boundaries and whereby the sealing member is integral with the disc.

According to a second aspect of the invention there is provided a rotor disc for use in an axial flow turbomachine having a main flow annulus which includes a rotatable annular flow boundary fixed in relation to and spaced from the periphery of the disc, and a non-rotatable annular flow boundary axially adjacent to and spaced from the rotatable boundary, wherein the disc comprises an annular sealing member which extends from the disc periphery to bridge the gap between the rotatable and non-rotatable flow boundaries, whereby the sealing member is integral with the disc.

Preferably the sealing member extends radially of the disc periphery and has a generally arcuate profile.

The disc periphery may be adapted to receive a plurality of rotor blades and the sealing member adapted to restrain the blades axially in relation to the disc.

In addition the sealing member may include an annular abutment surface for restraining the blades.

Preferably the disc periphery is provided with a plurality of blade retention slots which extend between opposing sides of the disc and into the sealing member. The slots may also define a generally dove tail shaped opening in the sealing member.

The rotatable flow boundary may be defined by a plurality of rotor blade platform segments, and the non-rotatable flow boundary by a plurality of stator vane platform segments.

The sealing member may also be adapted to engage the underside of the rotatable flow boundary, and extend along the underside of the non-rotatable boundary to form a labyrinth seal at it's distal end.

BRIEF DESCRIPTION OF THE DRAWINGS

The invention will now be described in greater detail, by way of example only, with reference to the accompanying drawings, in which.

DESCRIPTION OF PREFERRED EMBODIMENTS

Figure 1:
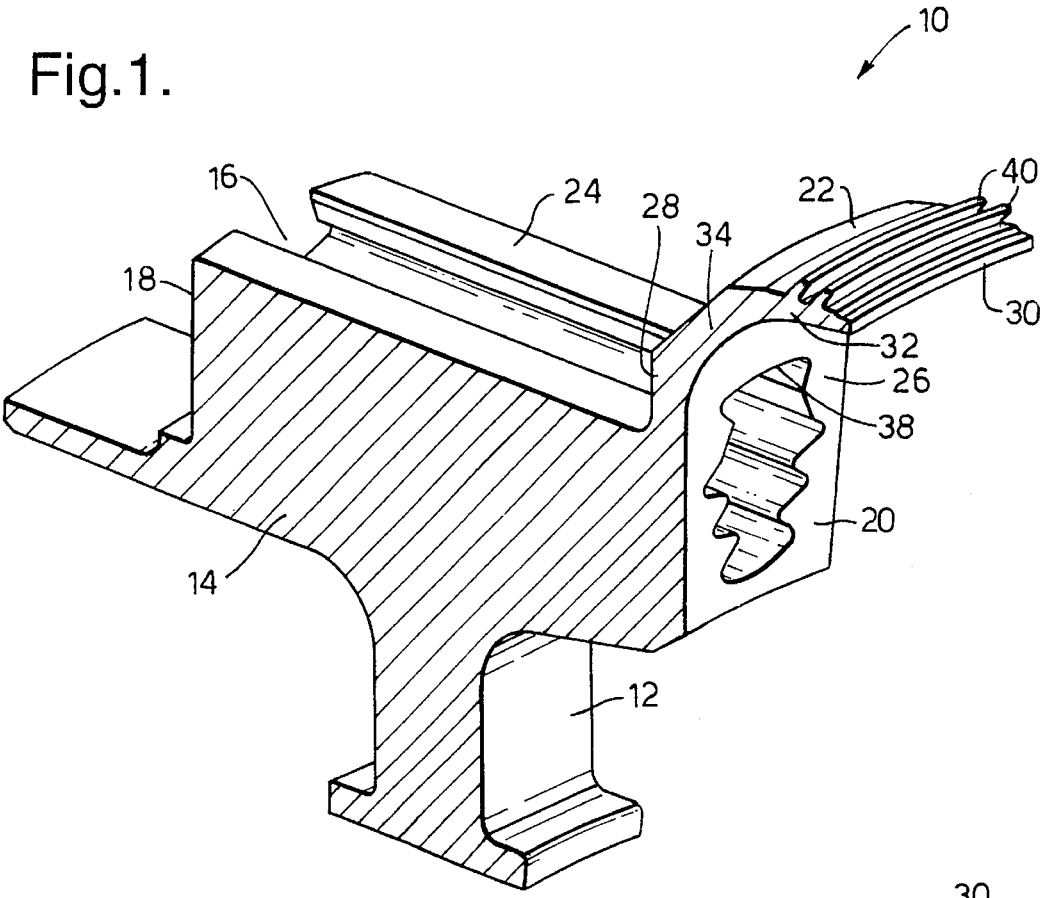
FIG. 1 is a perspective view of a segment of the periphery of a rotor disc constructed in accordance with the invention.

Referring to FIG. 1, there is shown a segment of the outer periphery of a disc 10 for use in an axial flow turbomachine. The disc 10 is shaped in the usual sense in accordance with the operational loads it supports, and includes a central hub portion (not shown), a radially extending neck portion 12 and a radially outer rim portion 14. The disc cross-section has a generally symmetrical profile which splays outwards at the radially outer end of the neck portion 12. The rim portion 14 is dimensioned in accordance with blade fixing requirements and as such has an axial dimension greater than that of the neck portion 12.

A plurality of circumferentially spaced axial root slots 16 are formed in the rim portion 14 at the disc periphery. Each slot (only one of which is shown) extends from one side of the disc to the other to form an elongated axial blade retention feature. In the example shown the root slot 16 is configured to receive a rotor blade having a fir tree root fixing portion, but it will be appreciated that other axial root configurations could used without departing from the scope of the invention.

Figure 2:
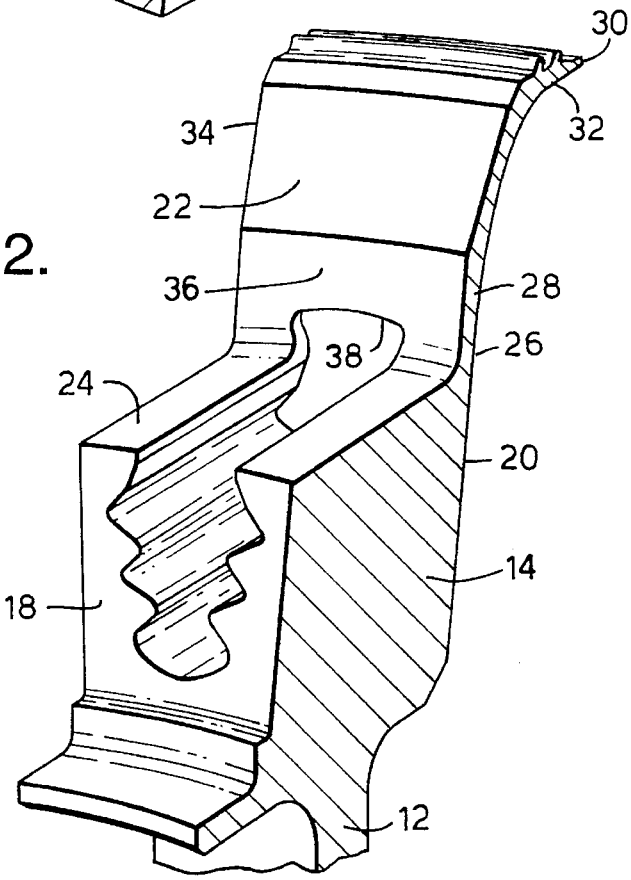
FIG. 2 is a perspective view of the disc segment of FIG. 1 viewed in an opposing direction.

Referring now to FIG. 2, on one side 18 of the disc the root slot 16 is adapted to receive the root portion of a rotor blade, while on the other side 20 the rim portion 14 is adapted to restrain the blade axially within the slot 16. The rim portion is provided with an axially extending annular seal member 22 which extends radially of the disc periphery 24. As can best be seen with reference to FIG. 1, the seal member 22 has a generally arcuate profile. At it's proximal end 26 the seal member 22 includes a radially extending portion 28, and at it's distal end 30 an axially extending portion 32. The seal member 22 further includes an inclined portion 34 which extends between both it's proximal and distal ends 26 and 30.

As shown in FIG. 2, the radially extending portion 28 defines an axially facing circumferential abutment surface 36 for restraining the blades within the slot. The slot 16 extends through the sealing member in order to avoid surface discontinuities and the like which would otherwise occur if the slot were to terminate in the region of abutment surface 36. In order to minimise stress concentration effects the slot 16 also opens out to define a generally dove-tail shaped opening 38 in the seal member radially of the disc periphery 24.

Towards the distal end 30 of the seal member 22 the axially extending portion 32 is provided with a series of serrations 40 which define a labyrinth type seal when combined with adjacent stationary structure. The exact nature of this arrangement will be described later.

Figure 3:
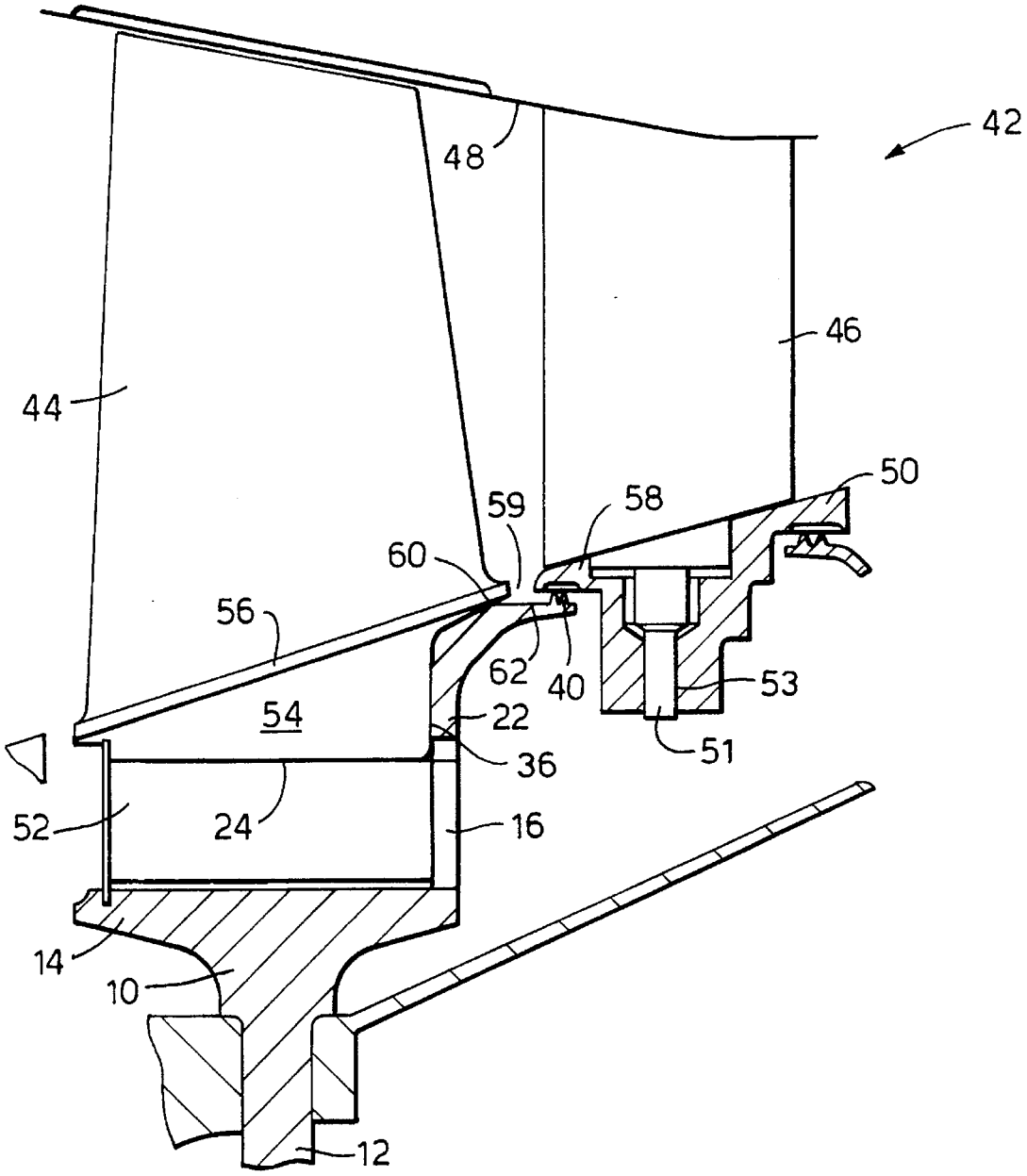
FIG. 3 is a sectioned side view of an axial flow compressor having a disc constructed in accordance with the invention.

The invention is shown in FIG. 3 in relation to an axial flow compressor. The compressor, generally indicated at 42, includes an array of rotor blades 44 secured to the periphery of a diec 10 in the manner described, and a plurality of adjacent stator bladee 46 which are secured at one end to the internal periphery of a cylindrical compressor casing 48 and at the other to a vane support ring 50. The vanes are of the variable stagger type and are each provided with a stub axle extension 51 which locates in a corresponding aperture 53 formed in the ring support 50. The rotor blades 44 each include a root portion 52 which locates in a respective one of the slots 16, and a shank portion 54 which engages the abutment surface 36 of the seal member.

The compressor has an outer flow boundary defined by the casing structure 48, and an inner flow boundary defined by adjacent rotor blade and stator vane platform sections 56 and 58. The rotor blade platforms 56 are integral with the blades and combine to form a continuous flow annulus around the disc periphery 42, whereas, in this example at least, the stator vane platforms 58 are integral with the fixed vane support ring 50.

In accordance with the invention the seal member 22 extends along the underside of the support ring 50 to seal the axial gap 59 between the ring 50 and adjacent platform sections 56. The serrated radial extensions 40 formed towards the distal end of the seal member cooperate with the underside of the ring 50 to provide an effective labyrinth seal between the seal member and the ring. Further sealing is accomplished by engagement of the seal member with the rotor blade platform sections 56 at 60.

As can be determined from FIG. 3 the invention effectively reduces the stator well region 62, between adjacent rotor and stator flow boundaries 56 and 58, to a minimum. This provides for improved aerodynamic efficiency and compressor stability. A further advantage of the present invention is that the structural integrity of the disc is improved. For example, in the event of a rotor blade failure the continuous nature of the seal member acts to prevent the phenomenon know as un-zipping. If a rotor blade is lost from a conventional bladed disc assembly there is an associated decrease in disc rim resilience due to the resultant empty blade fixing slot. Under extreme loading conditions this can result in further blades being lost as neighbouring root slots open up. Obviously a disc constructed in accordance with the invention would help to prevent such secondary failures as disc rim resilience would reduce by a lesser extent.

I claim:

1. A sealing arrangement for use in an axial flow turbo machine having a main flow annulus which includes:

a rotor disc, a portion of the rotor disc defining a disc periphery, a rotatable annular flow boundary fixed in relation to and spaced from the disc periphery, a non-rotatable annular flow boundary axially adjacent to and spaced from the rotatable annular flow boundary to form a gap therebetween, and an annular sealing member formed integrally with the disc periphery and extending from the disc periphery to bridge the gap between the rotatable and the non-rotatable annular flow boundaries.

2. A sealing arrangement as claimed in claim 1 wherein the sealing member extends radially of the disc periphery.

3. A sealing arrangement as claimed in claim 1 wherein the sealing member has a generally arcuate profile.

4. A sealing arrangement as claimed in claim 1 wherein the disc periphery is formed with a plurality of blade retention slots to receive a plurality of rotor blades, and the sealing member includes an abutment surface operative in use to restrain the rotor blades axially in relation to the rotor disc.

5. A sealing arrangement as claimed in claim 4 wherein the sealing member includes an annular abutment surface for restraining the blades.

6. A sealing arrangement as claimed in claim 4 wherein the plurality of blade retention slots provided in the disc periphery extend between opposing sides of the disc periphery and into the annular sealing member.

7. A sealing arrangement as claimed in claim 6 wherein each of the blade retention slots defines a generally dove tail shaped opening in the annular sealing member.

8. A sealing arrangement according to claim 1 wherein the rotatable annular flow boundary is defined by a plurality of rotor blade platform segments, and the non-rotatable flow boundary is defined by a plurality of stator vane platform segments.

9. A sealing arrangement according to claim 1 wherein the rotatable annular flow boundary is defined by a plurality of adjacent rotor blade platform sections, and the non-rotatable annular flow boundary is defined, at least partially, by a stator vane support ring.

10. A sealing arrangement according to claim 1 wherein the rotatable annular flow boundary has an underside and the sealing member includes means for sealingly engaging the underside of the rotatable annular flow boundary.

11. A sealing arrangement according to claim 1 wherein the sealing member has a distal end remote from the disc periphery which extends along an underside of the non-rotatable annular flow boundary.

12. A sealing arrangement according to claim 1 wherein the rotatable annular flow boundary has an underside and a means included in a distal end of the annular sealing member for sealingly engaging the underside of the rotatable annular flow boundary, the distal end of the annular sealing member forming a labyrinth seal with the underside of the non-rotatable annular flow boundary.

13. A rotor disc for use in an axial flow turbo machine having a main flow annulus which includes:

a disc periphery formed by an outer radial portion of the rotor disc, a rotatable annular flow boundary fixed in relation to and spaced from the disc periphery, a non-rotatable annular flow boundary axially adjacent to and spaced from the rotatable annular flow boundary to form a gap therebetween, and an annular sealing member formed integrally with the disc periphery and extending from the disc periphery to bridge the gap between the rotatable and the non-rotatable annular flow boundaries.

14. A rotor disc as claimed in claim 13 wherein the annular sealing member extends radially of the disc periphery.

15. A rotor disc as claimed in claim 13 wherein the annular sealing member has a generally arcuate profile.

16. A rotor disc as claimed in claim 13 wherein the disc periphery is formed with a plurality of blade retention slots to receive a plurality of rotor blades, and the annular sealing member is adapted to restrain the blades axially in the rotor disc.

17. A rotor disc as claimed in claim 16 wherein the annular sealing member includes an annular abutment surface for restraining the plurality of rotor blades.

18. A rotor disc as claimed in claim 16 wherein the plurality of blade retention slots provided in the disc periphery extend between opposing sides of the disc periphery and into the annular sealing member.

19. A rotor disc as claimed in claim 18 wherein each of the blade retention slots defines a generally dove tail shaped opening in the annular sealing member.

20. A rotor disc according to claim 13 wherein the rotatable annular flow boundary is defined by a stator vane support ring, and the non-rotatable annular flow boundary is defined by a plurality of stator vane platform segments.

21. A rotor disc according to claim 13 wherein the rotatable annular flow boundary is defined by a plurality of rotor blade platform segments, and the non-rotatable annular flow boundary is defined, at least partially, by a stator vane support ring.

22. A rotor disc according to claim 13 wherein the annular sealing member includes means for sealingly engaging an underside of the rotatable annular flow boundary.

23. A rotor disc according to claim 13 wherein the distal end of the annular sealing member extends along an underside of the non-rotatable annular flow boundary.

24. A rotor disc according to claim 13 wherein the distal end of the annular sealing member forms a labyrinth seal with the underside of the non-rotatable annular flow boundary.

* * * * *